United States Patent [19]

Lewis et al.

[11] Patent Number: 4,971,679

[45] Date of Patent: Nov. 20, 1990

[54] PLASTICIZER AND METHOD OF PREPARING PITCH FOR USE IN CARBON AND GRAPHITE PRODUCTION

[75] Inventors: Irwin C. Lewis, Strongsville; Terrence A. Pirro, Cleveland, both of Ohio

[73] Assignee: Union Carbide Corporation, Danbury, Conn.

[21] Appl. No.: 419,277

[22] Filed: Oct. 10, 1989

[51] Int. Cl.[5] ..... C10C 3/04

[52] U.S. Cl. ..... 208/4; 208/6; 208/39

[58] Field of Search ..... 208/4, 39, 6

[56] References Cited

U.S. PATENT DOCUMENTS

| | | | |
|---|---|---|---|
| 2,991,241 | 7/1961 | Renner | 208/4 |
| 3,080,245 | 3/1963 | Barnett, Jr. et al. | 208/34 |
| 3,856,657 | 12/1974 | Sunfeld et al. | 208/6 |
| 3,909,389 | 9/1975 | Ruckel et al. | 208/4 |
| 4,013,540 | 3/1977 | Mayle et al. | 208/4 |
| 4,096,056 | 6/1978 | Hagwood et al. | 208/4 |
| 4,664,774 | 5/1987 | Chu | 208/34 |
| 4,750,984 | 6/1988 | Ott | 208/39 |
| 4,755,276 | 8/1988 | Lewis | 208/22 |
| 4,762,566 | 7/1988 | Greinke | 106/284 |
| 4,892,641 | 1/1990 | Fu et al. | 208/6 |

*Primary Examiner*—Helane E. Myers
*Attorney, Agent, or Firm*—E. Lieberstein

[57] ABSTRACT

A plasticizer for use in the manufacture of pitch which forms a fluid at room temperature consisting essentially of a tar composed of low molecular weight and polymerized aromatic hydrocarbons having a molecular weight distribution characteristic which is bimodel. The plasticizer is formed by reacting a tar or distillate precursor with oxygen under controlled conditions of temperature and time.

8 Claims, 5 Drawing Sheets

FIG. 1A
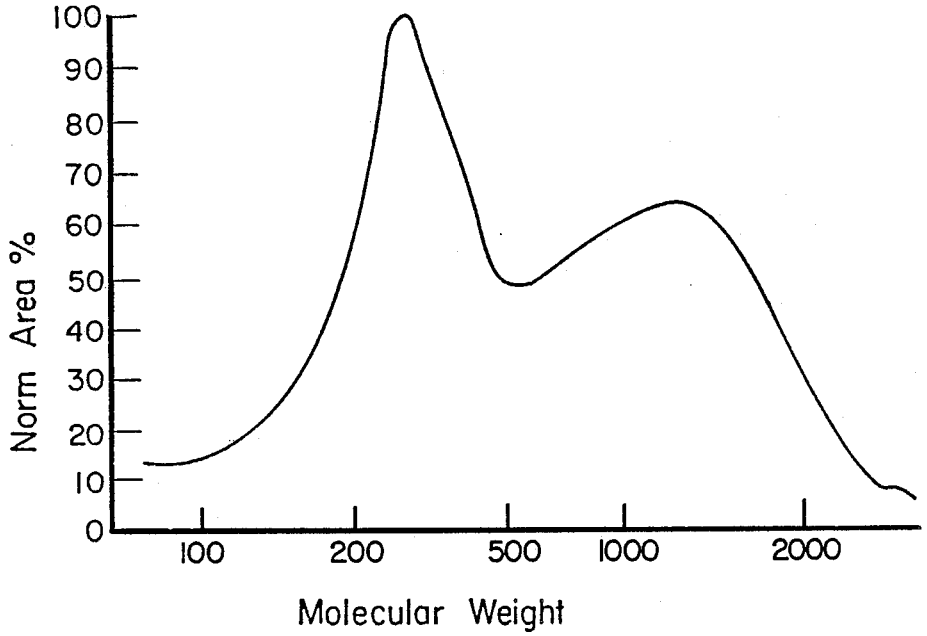
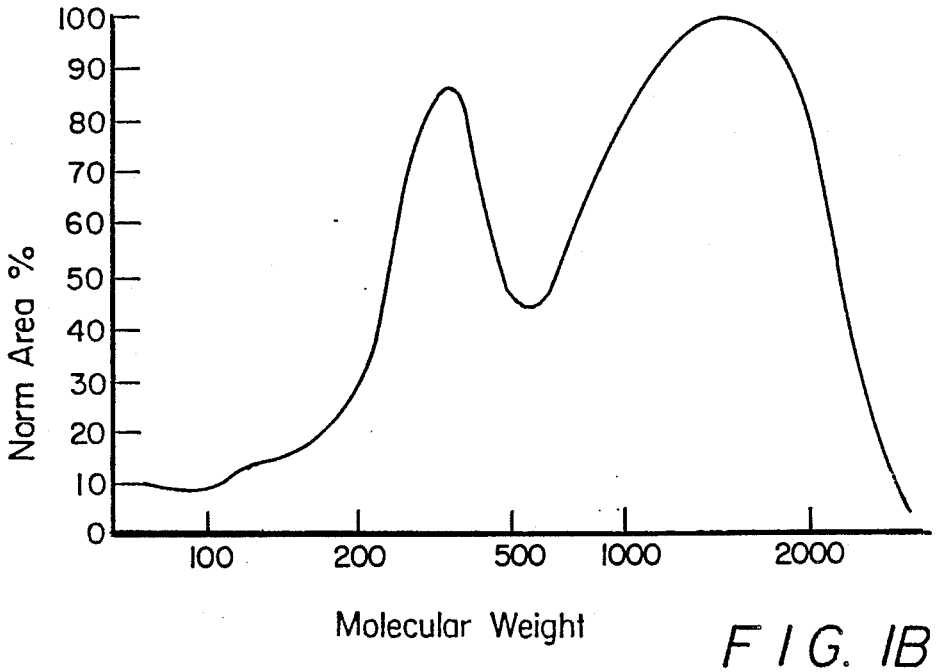
FIG. 1B

PLASTICIZER AND METHOD OF PREPARING PITCH FOR USE IN CARBON AND GRAPHITE PRODUCTION

FIELD OF THE INVENTION

This invention relates to a plasticizer for use in the manufacture of pitch, a method for forming a plasticizer for use in manufacturing pitch and to a method of preparing pitch for use in the manufacture of carbon and graphite products.

BACKGROUND OF THE INVENTION

Articles of carbon and graphite are conventionally produced by mixing a finely divided carbonaceous filler with a binder and extruding or molding the mixture. The carbonaceous filler may be a petroleum or coal-derived coke, powdered graphite, carbon flour or the like. The binder is usually a carbonaceous pitch derived from coal or petroleum. Pitches are also used as impregnants to fill the porosity of carbonized articles. Subsequent carbonization of impregnated carbons leads to higher density and strength. Pitches are a complex mixture of polynuclear aromatics generally derived from the thermal treatment of coal tar or a petroleum tar. Pitches are glass-like solids which gradually soften above room temperature and transform to a low viscosity fluid at elevated temperatures. The temperature at which pitch begins to exhibit liquid properties is referred to in the art as the softening point. The softening points of pitches can vary considerably depending on the selection of organic feedstock and subsequent hermal treatment. The softening point of pitch is usually determined by the Mettler procedure as defined in ASTM-D-3104-75.

For pitch to be useful as a binder or impregnant in the production of carbon or graphite products it should have the highest possible coke yield after carbonization and a softening point within a specified range. Coke yield generally increases with pitch softening point. The coke yield of a pitch is designated in the art as the Modified Conradson Carbon Value (MCC) and is determined using the procedure in ASTM-D-189. If the softening point of the pitch is too high, the processability of the carbon or graphite article is substantially affected. For example, in the production of graphite electrodes, the limitations in current commercial equipment limit the useful softening points of both binder and impregnant pitches to the range of about 90°-120° C. Electrode binder pitches with softening points in this range generally have MCC values below 60% while impregnant pitches with these softening points have MCC values of about 50% or less. Pitches with softening points below 90° C. have low coking values. The use of low coking value pitches increases the porosity and depresses the density and strength of the carbon or graphite article made from such pitch. Although high softening point pitches with softening points in excess of 200° C. and coking values as high as about 80% are commercially available, these materials are not currently useable in conventional carbon processes unless the softening point is reduced to about 120° C. or lower. The pitch softening point may be reduced through the addition of a plasticizer. Materials currently used as plasticizers for pitch include petroleum and coal tar distillates, fatty acids such as oleic and stearic acid and others. Unfortunately, all of these materials have essentially no coking value and their use thus negates any benefit which might be expected from the use of a high softening point, high coking value, pitch.

A "plasticizer" has been discovered in accordance with the present invention for use in the manufacture of pitch having a higher carbon yield than heretofore attainable at a given softening point. For purposes of the present invention the term "plasticizer" means a material which is essentially totally soluble in pitch, has a high coking value and depresses the pitch viscosity to reduce its softening point. The present invention also encompasses a method of preparing a pitch for use in the manufacture of carbon and graphite products. Pitches made according to this invention have MCC values above at least a minimum of about 50% MCC and a preselected softening point within a range of between 90°-120° C.

SUMMARY OF THE INVENTION

The plasticizer of the present invention comprises a tar composed of polymerizable aromatics and has a glass transition temperature below 25° C., an MCC value of at least 20% and a molecular weight distribution characteristic which is bimodal. The glass transition temperature of tars and pitches can be determined by standard differential scanning calorimetry techniques as described in: J. B. Barr and I. C. Lewis, Thermo Acta, 52, 297 (1982). The molecular weight distribution can be determined by gel permeation chromatography using procedures described in R. A. Greinke and L. M. O'Connor, Anal. Chem., 52. 1877 (1980).

The present invention is also directed to a method of forming a plasticizer for use in the manufacture of pitch comprising:

selecting as a precursor for said plasticizer, an aromatic distillate or an aromatic tar which is substantially free of infusible solids such as: a petroleum gas oil, decant oil distillate, coal tar distillate, decant oil or a pyrolysis tar, reacting the tar precursor with a source of oxygen or elemental sulfur while heating the tar precursor within a temperature range of between about 200° C. to 350° C., and adjusting the reaction time to form a plasticizer flowable at room temperature with a minimum coking value of about 20% MCC.

The present invention is also directed to a method of forming a pitch having a substantial carbon yield for use in the manufacture of carbon and graphite products comprising the steps of:

selecting as a precursor an aromatic distillate or an aromatic tar which is substantially free of infusible solids such as: a petroleum gas oil, decant oil distillate, coal tar distillate, decant oil or pyrolysis tar, reacting the precursor with a source of oxygen or elemental sulfur to form a plasticizer flowable at room temperature with the reaction time adjusted to attain a predetermined minimum coking value of at least about 20% MCC;

selecting a pitch with a softening point substantially above 130° C.; and blending said plasticizer with said selected pitch at a temperature above the softening point for the selected pitch to form a blended pitch having a preselected softening point below 130° C. and a coking value for said blend of above 50% MCC.

BRIEF DESCRIPTION OF THE DRAWINGS

Other advantages of the present invention will become apparent from the following detailed description of the invention when read in conjunction with the accompanying drawings of which:

FIG. 1A is a gel permeation chromatogram of a plasticizer formed by treating a precursor in accordance with the present invention;

FIG. 1B shows another typical gel permeation chromatogram of a plasticizer formed in accordance with the present invention;

DESCRIPTION OF THE PREFERRED EMBODIMENT

The plasticizer of the present invention is formed using as a precursor an aromatic distillate or an aromatic tar which is substantially free of infusible solids such as: a petroleum gas oil, a decant oil distillate, a coal tar distillate, a decant oil or a pyrolysis tar. Any conventional distillation procedure may be used for forming the distillate of the petroleum or coal tar feedstock. The precursor should preferably contain low molecular weight aromatic hydrocarbons with substantially no infusible solids and have an average molecular weight distribution below 350 amu. The precursor will have zero or a low carbon yield at atmospheric pressure.

The precursor is treated with a source of oxygen or with elemental sulfur to form the plasticizer of the present invention. The source of oxygen may be provided by blowing air into the precursor. The air blowing should occur with the precursor heated to within a controlled temperature range of between 200° C.–350° C., preferably 250°–350° C., to allow for low boiling materials and water by-products to distill. The air blowing should be continued until the MCC value has reached at least about 20% and preferably between 20–30% and with the reaction material having a liquid characteristic at room temperature. Excessive air blowing raises the MCC value but forms a material which is solid at room temperature and is a poor plasticizer. Insufficient air blowing will not increase the MCC value to the desired minimum value of at least about 20%.

The treatment with elemental sulfur is preferred over the treatment with oxygen. The use of sulfur permits more accurate control of final plasticizer properties. Sulfur is also a more effective polymerization agent, as compared to oxygen, for very low molecular weight distillates. Sulfur levels of 10%–25% by weight are preferably used and the blends are heated at temperatures of between 200° C.–350° C., preferably 200° C.–300° C., for varying lengths of time. As with air blowing the objective is to convert the precursor into a plasticizer which is flowable as a liquid at room temperature and which has an MCC value of at least about 20%.

Figure 1C:
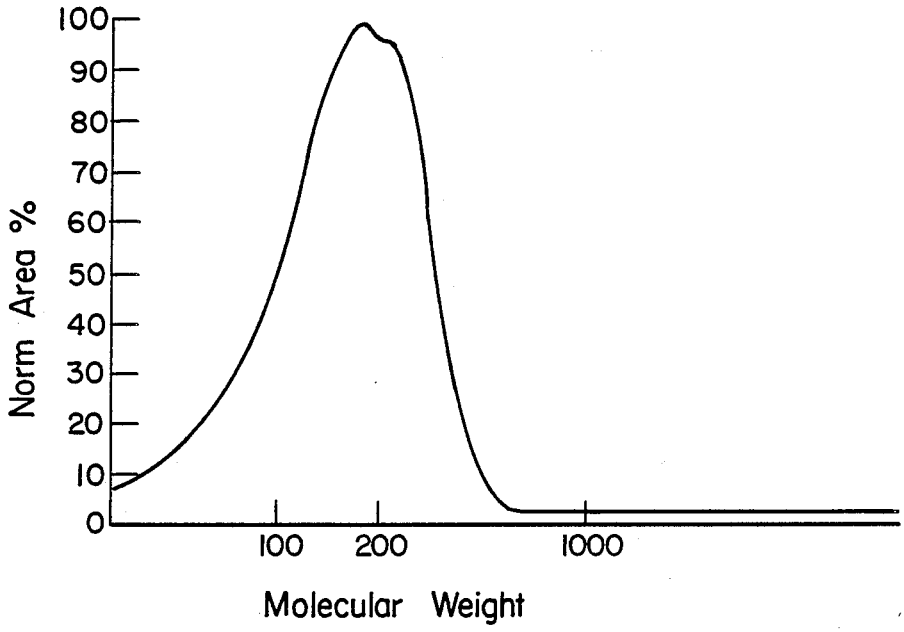
FIG. 1C is a gel permeation chromatogram of the untreated precursor of FIG. 1A.

The plasticizer of the present invention has been shown, through conventional gel permeation chromatography, to possess the unusual property of a bimodal molecular weight distribution. This bimodal distribution is evident from FIG. 1A and FIG. 1B respectively. The bimodal distribution has two distinct peaks with the first peak having an average molecular weight below 350 amu and a second peak which has an average molecular weight of above 600 amu. This bimodal molecular weight distribution contrasts sharply with a conventional unimodal molecular weight distribution characteristic for an untreated tar distillate as shown in FIG. 1C which is a gel permeation chromatogram for the untreated precursor of FIG. 1A.

The following are examples of the preparation of a plasticizer in accordance with the present invention:

Example I: Sulfur-Treated Gas oil 1445 gms of gas oil was weighed into a 2000 ml reaction flask. 255 gm of sublimed sulfur was added to the gas oil. The reactor, equipped with a stirrer, condenser, and receiver was flushed with argon for one hour at 2.0 standard cubic feet per hour (scfh). The reactor was rapidly heated to 300° C. and held at temperature for four hours at a flow rate of 0.5 scfh, argon. The product was allowed to cool under an argon flush. The product had a yield of 53.8% based on the total ingredients or a yield of 63.3% based on the gas oil alone. The resultant tar had 4.9% final sulfur content and MCC of 29.0%.

Example II: Sulfur-Treatment of Coal Tar Distillate 1476 gms of a coal tar distillate was weighed into a 2000 ml reaction flask and 164 gm of sublimed sulfur was added to the coal tar distillate.

The reactor was heated to 300° C. and held at temperature for six hours at a flow rate of 0.5 scfh argon. The product was allowed to cool under argon.

The tar product had a yield of 62.3% based on the total ingredients, or a yield of 69.2% based on the coal tar distillate alone. The resultant tar had 2.2% final sulfur content and a MCC of 30.5%.

Example III: Air-Blown pyrolysis Tar 100.0 gm of pyrolysis tar derived from cracking of gas oil, was weighed into a 150 ml reaction flask. The reaction flask was fitted with distillation head, condenser, receiver, and argon gas inlet. A magnetic stir bar was used to provide agitation. The reactor was flushed for several hours with argon at 2.0 scfh. The argon flow was turned off and air was introduced via a sparge tube at the rate of 1.0 scfh. The reactor was taken to 250° C. and held at temperature for 10 hours.

The resultant tar had a yield of 91.3% based on the original pyrolysis tar and an MCC of 26.0%.

Example IV: Sulfur-Treatment of Decant Oil Distillate 42.5 gms of a distillate obtained by distilling a decant oil was weighed into a 150 ml reaction flask similar to that used for air-blowing of pyrolysis tar. 7.5 g of precipitated sulfur was added to the distillate. After flushing with argon, the reactor was taken to 300° C. and held at temperature for six hours while stirring under an atmosphere of argon. The tar product was allowed to cool under argon.

The product had a yield of 81.6% based on the total ingredients or a yield of 96.0% based on the decant oil distillate alone. The resultant tar had 3.9% final sulfur content and an MCC of 22.4%.

An improved pitch of appropriate softening point is formed in accordance with the present invention by blending the plasticizer with a commercially available high softening point pitch. It is generally preferred to use the highest softening point pitch which is available and preferably a pitch that does not contain an appreciable amount of mesophase, i.e. below about 5% mesophase. Generally, the initial pitch softening point would be <200° C. for coal tar pitches and less than 240° C. for petroleum pitches.

Figure 2:
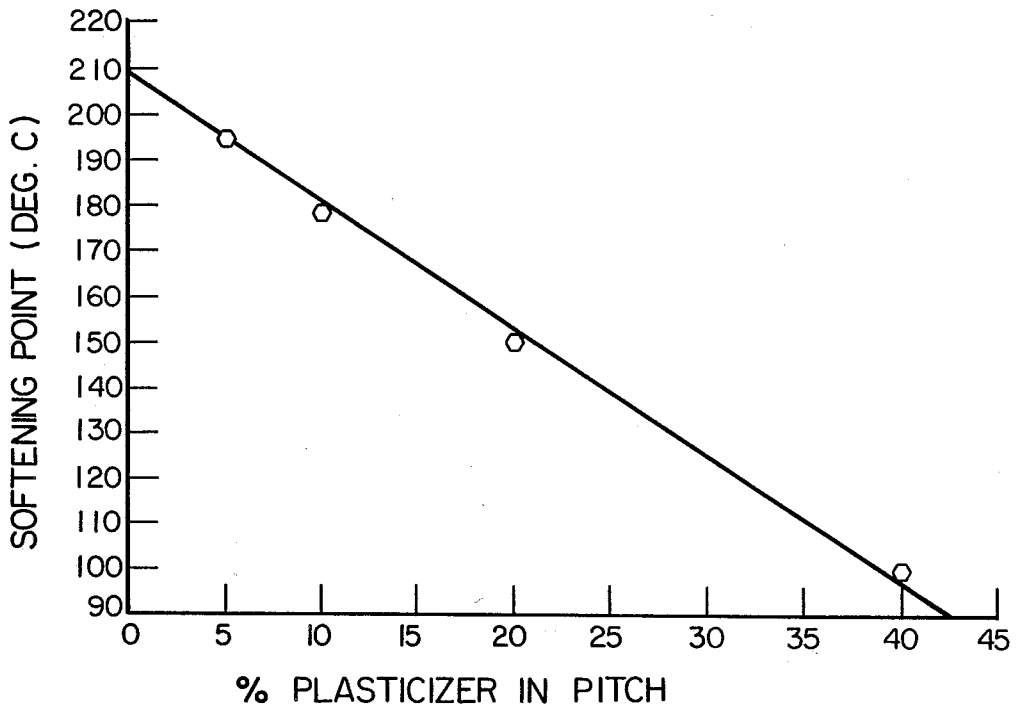
FIG. 2 is a graph illustrating the relationship between softening point and percent of plasticizer blended into a preselected high softening point pitch.
Figure 3:
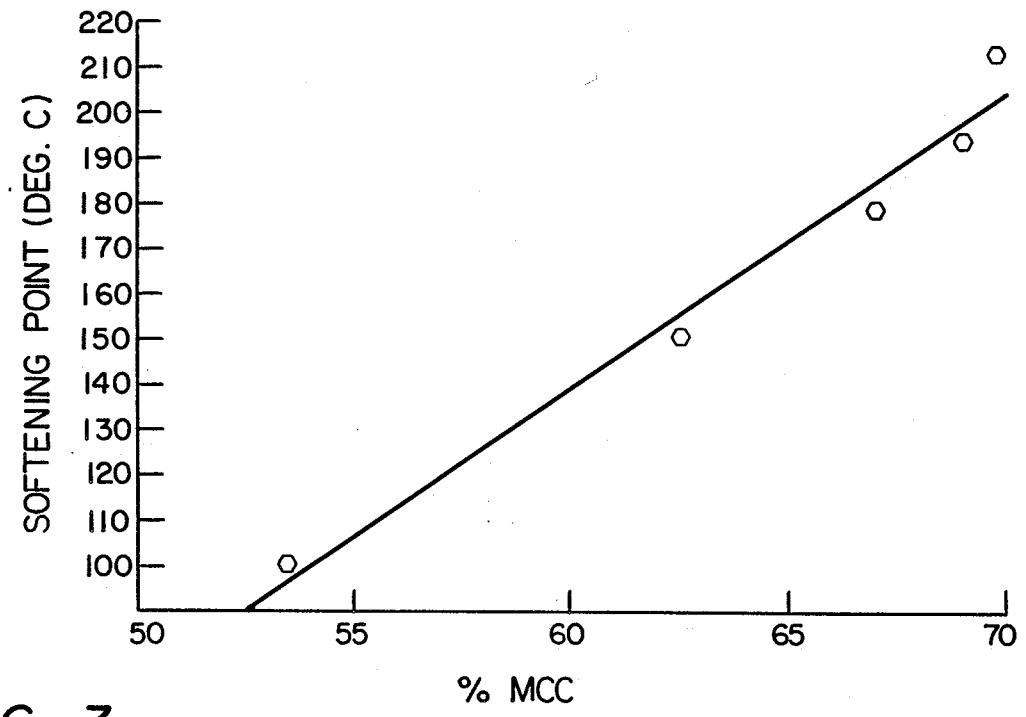
FIG. 3 is a graph of the softening point versus percent coking value for a blended pitch product formed in accordance with the present invention.
Figure 4:
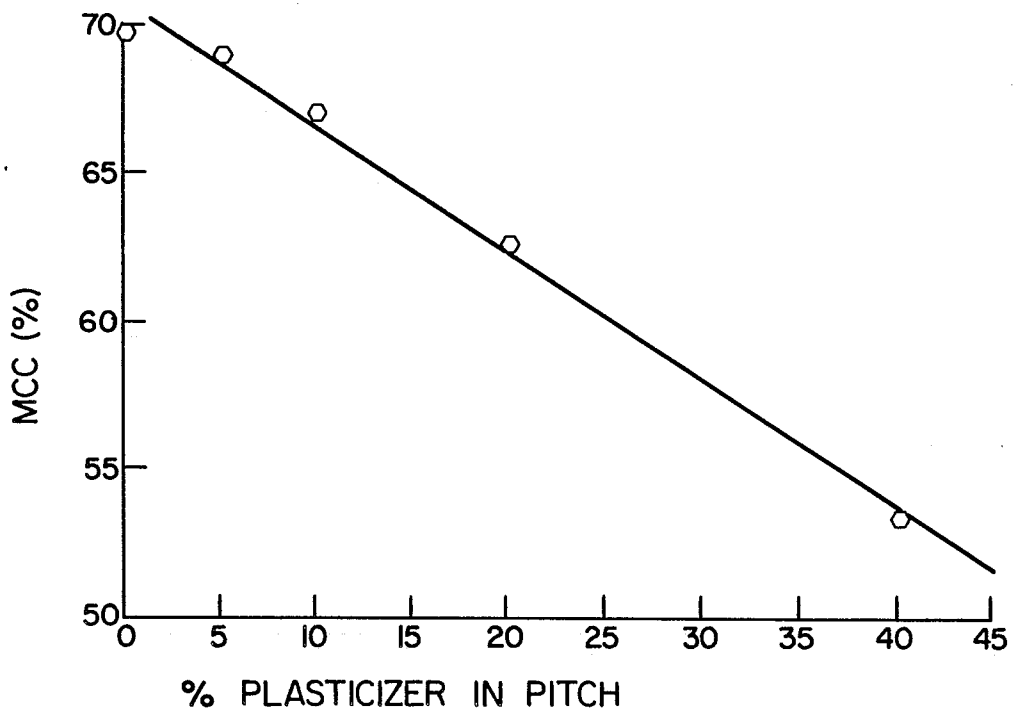
FIG. 4 shows another graph of the relationship between coking value in percent versus percent of plasticizer for a preselected high softening point pitch corresponding to the pitch used in the graph of FIG. 2.

To determine the appropriate blend level, a series of blends are prepared containing different amounts of plasticizer for the selected high softening point pitch. The best procedure is to stir the blended plasticizer and pitch at about 80° C. above the Mettler softening temperature for the high softening point pitch. A plot of softening point versus percent plasticizer blended into a commercially available petroleum pitch having a 210° C. softening point is shown in FIG. 2 The plasticizer is formed from a sulfur treated gas oil following the teaching of the present invention. The desired softening point for the improved blend may be chosen from this curve thereby indicating the percent of plasticizer needed to form the improved blend. A plot of the softening point versus percent coking value (MCC) for the blended pitch product is shown in FIG. 3 and a similar plot of the relationship between coking value in percent versus percent of plasticizer for a preselected high softening point pitch corresponding to the commercial 210° pitch used in the graph of FIG. 2 is shown in FIG. 4. From the slopes of of these graphs, the efficiency of various plasticizers can be explored. It is advantageous to have the most rapid change in softening point for a given change in the amount of plasticizer and the least change in MCC for the same change in the amount of plasticizer.

The plasticizer additive always increases the coking rate of the pitch. The coking rate can be determined by measuring the time to achieve a fixed viscosity of 1000 poise at a coking temperature of 420° C. to 450° C.

The following examples are illustrative of the method of blending to form an improved pitch in accordance with the present invention and the characteristics for the improved pitch:

A. Blending of Sulfur-Treated Gas Oil with High Softening point (S.P.) Pitches

Blends of the sulfur-treated gas oil, the sulfur-treated coal tar distillate and the air-blown pyrolysis tar were prepared using four different base pitches: a petroleum pitch derived from decant oil with an S.P.=213° C., MCC=70% (hereafter referred to as Pitch A); a coal tar pitch containing 15% "Q.I." i.e. quinoline insolubles with an SP=163° C. and a MCC=71% (hereafter Pitch B); a solids-free coal tar pitch with an S.P.=153, MCC=64% (hereafter Pitch C); and a solids-free coal tar pitch with S.P.=201° C., MCC=75% (hereafter Pitch D).

The blends were prepared by stirring the appropriate amount of plasticizer with the base pitch at a temperature 80° C. higher than the S.P. of the base pitch while under an inert gas atmosphere. After cooling, the Mettler softening point and MCC value were determined for the blends. Each blend was prepared sequentially by adding the appropriate amount of plasticizer to the previous blend. The "coking" rate of several of the blends were determined by measuring the time required to reach a viscosity of about 1000 poise while heat treating at 440° C.

The results are summarized in Table I for the four different pitches. The important properties of the pitches, namely softening point (S.P.) and carbon yield (MCC) are given in the last two columns of the table. From the examples, the superiority of these properties can be observed. For example, the petroleum pitch blend No. 4 of Example V has an S.P. of essentially 100° C. and an MCC of essentially 54%. Commercial petroleum pitch used as an impregnant has an S.P. of 122° C. and an MCC of only 51% to 52%. The impregnant pitch of the invention can therefore be used at a much lower temperature and still provide a much higher carbon yield than the commercial pitch. A similar result can be seen for the pitches of blend 2 and blend 3 of Example VII and blend 3 of Example VIII which have better properties than conventional impregnants.

The binder pitches prepared from the Q.I. containing coal tar pitch (Example VI) have slightly better MCC values than conventional coal tar binder pitches.

TABLE I

| BLENDED PITCH | TAR (%) | PITCH (%) | BLEND TEMP. | S.P. (C) | MCC (%) |
|---|---|---|---|---|---|
| | | Example V Blend Combining Tar From Example I With Pitch A | | | |
| Unblended Pitch A | 0.0 | 100.0 | 0.0 | 213.1 | 69.8 |
| Blend (1) | 5.0 | 95.0 | 300 | 194.1 | 69.0 |
| Blend (2) | 10.0 | 90.0 | 300 | 178.5 | 67.0 |
| Blend (3) | 20.0 | 80.0 | 300 | 150.3 | 62.5 |
| Blend (4) | 40.0 | 60.0 | 300 | 99.9 | 53.5 |
| | | Example VI Blend Combining Tar of Example I With Pitch B | | | |
| Unblended Pitch B | 0.0 | 100.0 | 0.0 | 163.3 | 71.3 |
| Blend (1) | 10.0 | 90.0 | 246 | 137.1 | 66.7 |
| Blend (2) | 20.0 | 80.0 | 217 | 119.8 | 62.6 |
| Blend (3) | 25.0 | 75.0 | 200 | 112.7 | 60.7 |
| | | Example VII Blend Combining Tar of Example I With Pitch C | | | |
| Unblended Pitch C | 0.0 | 100.0 | 0.0 | 163.1 | 63.7 |
| Blend (1) | 10.0 | 90.0 | 230 | 134.0 | 60.5 |
| Blend (2) | 20.0 | 80.0 | 216 | 118.4 | 56.9 |
| Blend (3) | 25.0 | 75.0 | 200 | 109.6 | 54.8 |
| | | Example VIII Blend Combining Tar of Example I With Pitch D | | | |
| Unblended Pitch D | 0.0 | 100.0 | 0.0 | 200.7 | 75.3 |
| Blend (1) | 10.0 | 90.0 | 280 | 181.0 | 72.4 |
| Blend (2) | 20.0 | 80.0 | 260 | 155.9 | 67.7 |
| Blend (3) | 35.0 | 65.0 | 235 | 122.6 | 59.9 |

B. Blending of Sulfur-Treated Coal Tar Distillate with High S.P. Pitches

The plasticizing tar prepared by reaction of sulfur and coal tar distillate (Example II) was used to plasticize the high S.P. petroleum pitch (Pitch A) and the high S.P. solid-free coal tar (Pitch D). The results are shown in Table II. Again, pitches with softening points of 120° C. to 125° C. are seen to have substantially higher coking values than conventional 120° C. S.P. solid-free pitches.

TABLE II

| BLENDED PITCH | TAR (%) | PITCH (%) | BLEND TEMP. | S.P. (C) | MCC (%) |
|---|---|---|---|---|---|
| | | Blend of Tar of Example II With Pitch A | | | |
| Unblended | 0.0 | 100.0 | 0.0 | 213.1 | 69.9 |
| Blend (1) | 10.0 | 90.0 | 300 | 181.6 | 66.2 |
| Blend (2) | 20.0 | 80.0 | 263 | 158.1 | 62.2 |
| Blend (3) | 37.5 | 62.5 | 238 | 121.4 | 55.4 |
| | | Blend of Tar of Example II With Pitch D | | | |
| Unblended | 0.0 | 100.0 | 0.0 | 200.8 | 75.3 |
| Blend (1) | 10.0 | 90.0 | 280 | 186.8 | 72.8 |
| Blend (2) | 20.0 | 80.0 | 240 | 161.4 | 68.1 |
| Blend (3) | 37.5 | 62.5 | 210 | 124.1 | 59.7 |

C. Blending of Air-Blown Pyrolysis Tar with High S.P. Pitch

The tar prepared by air-blowing pyrolysis tar (Example III) was used to plasticize the high S.P. petroleum pitch. The results are shown in Table III. The air blown pyrolysis tar is not as good a plasticizer as the sulfur-treated distillates since the MCC values are lower for comparable softening points.

TABLE III

| BLENDED PITCH | TAR (%) | PITCH (%) | BLEND TEMP. | S.P. (C) | MCC (%) |
|---|---|---|---|---|---|
| | | Blend or Tar of Example III With Pitch A | | | |
| Unblended | 0.0 | 100.0 | 0.0 | 213.1 | 69.8 |
| Blend (1) | 10.0 | 90.0 | 300 | 184.8 | 66.1 |
| Blend (2) | 20.0 | 80.0 | 265 | 166.1 | 61.9 |
| Blend (3) | 39.2 | 60.8 | 245 | 132.4 | 53.9 |

D. Sulfur-Treated Decant Oil Distillate from Example IV as a Coking Plasticizer

The sulfur-treated decant oil distillate (Example IV) was blending with the high S.P. petroleum pitch (A). The blending was carried out at 280° C. using a mixture of 30 gms of sulfur-treated distillate and 90 gms of high S.P. pitch. The product had an S.P.=137° C. and MCC=59%, indicating that the sulfur-treated distillate is an effective plasticizer.

E. Coking Reactivity of Plasticized Pitches

The rates of coking were measured for the plasticized pitches by monitoring the viscosity while heating at 440° C. in an inert atmosphere. As the pitch is heated at 440° C., it increases in viscosity as a result of thermal polymerization leading to formation of coke. Readings of viscosity are taken at various times up to a viscosity of 1000 poise. From a plot of log viscosity versus time, an apparent coking rate can be determined. The "coking" rate constants for various plasticized pitches are shown in Table IV. As can be seen, the plasticized pitches coke at faster rates than conventional pitches. The coking of these pitches as binders and impregnants can be achieved in shorter times and result in less pitch runout during coking.

TABLE IV

Coking Reactivity at 440° C. for Plasticized Pitches

| Plasticizer | High S.P. Pitch | Rate 440° C. |
|---|---|---|
| None | Petroleum (213° S.P.) | 4.7 |
| Sulfur-Treated Decant Oil Dist. | Petroleum (213° S.P.) | 5.2 |
| Air-Blown Pyrolysis Tar | Petroleum (213° S.P.) | 5.9 |
| Sulfur-Treated Coal Tar Dist. | Petroleum (213° S.P.) | 6.0 |
| Sulfur-Treated Gas Oil | Petroleum (213° S.P.) | 8.9 |
| None | High S.P. Coal Tar | 3.6 |
| Sulfur-Treated Coal Tar Dist. | High S.P. Coal Tar | 4.7 |
| Sulfur-Treated Gas Oil | High S.P. Coal Tar | 6.5 |

What we claim is:

1. A plasticizer for use in the manufacture of pitch consisting essentially of a tar composed of low molecular weight and polymerized aromatic hydrocarbons, having a glass transition temperature below 25° C., which forms a fluid at room temperature and has a coking value of at least 20% Modified Conradson Carbon Value (MCC) and a molecular weight distribution characteristic which is bimodal.

2. A plasticizer as defined in claim 1 wherein said bimodal characteristic has an average molecular weight distribution peak below 350 amu and an average molecular weight distribution peak above 600 amu.

3. A method of forming a plasticizer for use in the manufacture of pitch comprising:

selecting as a precursor an aromatic distillate or an aromatic tar which is substantially free of infusible solids;

reacting the precursor with a source of oxygen or elemental sulfur while heating the precursor within a temperature range of between about 200° C. to 350° C. over a controlled reaction time period; and adjusting said reaction time period to form a plasticizer flowable at room temperature with a predetermined minimum coking value of about 20% Modified Conradson Carbon Value (MCC).

4. A method as defined in claim 3 wherein the precursor is selected from a group consisting of a petroleum gas oil, a decant oil distillate, a coal tar distillate, a decant oil or a pyrolysis tar.

5. A method as defined in claim 3 wherein said precursor is reacted with elemental sulfur at levels of 10–25% by weight.

6. A method as defined in claim 3 wherein said tar precursor is selected with an average molecular weight distribution of below 500 amu.

7. A method as defined in claim 3 wherein said reaction temperature range is between about 200°–300° C.

8. A method of forming a blended pitch having a substantial carbon yield for use in the manufacture of carbon and graphite products comprising the steps of:

selecting as a precursor an aromatic distillate or an aromatic tar which is substantially free of infusible solids;

reacting the precursor with a source of oxygen or elemental sulfur to form a plasticizer flowable at room temperature with the reaction time adjusted to attain a predetermined minimum coking value of at least about 20% Modified Conradson Carbon Value (MCC);

selecting a pitch with a softening point substantially above 130° C.; and blending said plasticizer with said selected pitch at a temperature above the softening point for the selected pitch to form a blended pitch having a preselected softening point below 130° C. and a coking value, for said blend of above 50% Modified Conradson Carbon Value (MCC).

* * * * *

UNITED STATES PATENT AND TRADEMARK OFFICE

CERTIFICATE OF CORRECTION

PATENT NO. : 4,971,679

DATED : 11-20-90

INVENTOR(S) : Irwin C. Lewis
Terrence A. Pirro

It is certified that error appears in the above-identified patent and that said Letters Patent is hereby corrected as shown below:

Column 1, line 32, "her-" should read "ther-"

Column 2, line 30, "in R" should read "in: R"

Column 4, line 45, "pyrolysis" should read "Pyrolysis"

Signed and Sealed this

Twenty-first Day of April, 1992

*Attest:*

HARRY F. MANBECK, JR.

*Attesting Officer*

*Commissioner of Patents and Trademarks*